US006510658B1

(12) United States Patent
Müller-Peddinghaus

(10) Patent No.: US 6,510,658 B1
(45) Date of Patent: Jan. 28, 2003

(54) SYSTEM FOR FIXING SUN PROTECTION CLOTH

(76) Inventor: Reiner Müller-Peddinghaus, Klutstein 22a, Bergisch Gladbach (DE)

( * ) Notice: Subject to any disclaimer, the term of this patent is extended or adjusted under 35 U.S.C. 154(b) by 0 days.

(21) Appl. No.: 09/485,556

(22) PCT Filed: Jul. 9, 1998

(86) PCT No.: PCT/DE98/01976

§ 371 (c)(1),
(2), (4) Date: Feb. 14, 2000

(87) PCT Pub. No.: WO99/09273

PCT Pub. Date: Feb. 25, 1999

(30) Foreign Application Priority Data

Aug. 14, 1997 (DE) ..... 197 35 190

(51) Int. Cl.[7] ..... E04B 1/34
(52) U.S. Cl. ..... 52/74; 160/46; 135/88.06
(58) Field of Search ..... 52/63, 74, 222, 52/73; 135/87, 96, 79.6; 160/45, 76

(56) References Cited

U.S. PATENT DOCUMENTS 3,833,011 A * 9/1974 Duffy ..... 135/5 AT
3,847,171 A * 11/1974 Akers et al. ..... 135/5 AT
5,381,844 A * 1/1995 Stuben ..... 160/46
5,415,194 A 5/1995 Kaye
5,850,843 A * 12/1998 Mahood et al. ..... 135/88.06

FOREIGN PATENT DOCUMENTS

| | | |
|---|---|---|
| DE | 395172 | 5/1921 |
| DE | 2827432 | 2/1979 |
| DE | 9313313 | 2/1994 |
| DE | 29519259 | 12/1995 |
| FR | 2622913 | 11/1987 |

OTHER PUBLICATIONS

Journal: "Detail" H. 6, 1988, pp. 649–652.
Journal: "Detail" H. 6, 1994, pp. 792–794.
Journal: "deutsche bauzeitung" H. 9, 1993, pp. 102–108.

* cited by examiner

*Primary Examiner*—Carl D. Friedman
*Assistant Examiner*—Steve M Varner
(74) *Attorney, Agent, or Firm*—Diller, Ramik & Wight

(57) ABSTRACT

A system for fixing sun protection cloths to produce shade on projecting balconies of houses wherein two guiding elements extending parallel to each other and set at different heights are used, the lower guiding element being borne by stretching or retaining devices fixed to the balcony guard-rail or to the said guard-rail hand rail. The stretching or retaining devices consist of a supporting base, a retaining arm so that it can move on the support base, the guiding element being pulled by the movement of said retaining arm. In another embodiment or as a complement, the supporting base can be made to pivot about the hand rail.

15 Claims, 8 Drawing Sheets

SYSTEM FOR FIXING SUN PROTECTION CLOTH

BACKGROUND OF THE INVENTION

The invention relates to a system for fixing sun protection cloths made of widths of fabric for providing shade and as a screen for balconies or patios of houses, where the sun protection cloth is fixed to two guiding elements extending parallel to each other, such as tensioning wires or tensioning ropes at different heights, the ends of which are supported by stretching or retaining devices attached to the house.

A generic fixing system is known from German utility model 29519259, for example.

In the fixing method illustrated there, the sun protection cloths are fixed to the tensioning ropes with the aid of sliding hooks in a manner permitting displacement in the longitudinal direction of the tensioning ropes.

The disadvantage of the known fixing system is, however, that the tensioning ropes for supporting the sun protection cloths have to be fixed to side walls of the house. Consequently, the known system is, for example, not suitable for use with sun protection cloths for providing shade or acting as a screen on projecting balconies or on smooth house walls, owing to the absence of side walls in such circumstances.

SUMMARY OF THE INVENTION

The object of the invention is to create an easy-to-mount system for fixing sun protection cloths, which can be used to provide shade on projecting balconies or patios of houses.

According to the invention, the object is solved in that the stretching or retaining devices for the lower guiding element are fixed to the balcony guard-rail or the hand rail of the balcony guard-rail by means of detachable clamp-type or screw-type connections and can completely or partially be made to pivot and/or fixed by springs in a first plane located perpendicular to the longitudinal extension of the guard-rail or hand rail and/or in a send horizontal plane located perpendicular to the first plane.

Thus, in the system according to the invention, the stretching or retaining devices for the lower guiding element are clamped or screwed onto the balcony guard-rail or the hand rail of the balcony guard-rail. They can be pivoted and/or fixed by springs in a plane lying parallel to the longitudinal extension of the guard-rail, meaning that the effective distance between two stretching or retaining devices is variable, thus allowing tensioning of the ropes running between the stretching and retaining devices without having to use additional tensioning elements.

In addition, the retaining devices can be designed or fixed in such a way that they can also be pivoted in a plane located perpendicular to the longitudinal extension of the guard-rail or the hand rail.

As a result, the tensioning ropes can be pivoted in an arc about the hand rail, for example, so that the height and position of the lower guiding element can be adapted to the local conditions and the wishes of the user. For example, this makes it possible to adjust the inclination of the sun protection cloth or to open the sun protection cloth in such a way that it is virtually impossible to see onto the balcony from the outside. In this context, the length of the retaining device is designed in such a way as to ensure a sufficient distance between the tensioning rope or sun protection cloth and any plants present on the balcony.

In order to be able to perform the pivoting or rotary movements according to the invention, the stretching or retaining device is preferably designed as a supporting arm. In this context, the supporting arm is either in one piece or assembled from two or three pieces and displays, for example, a supporting base and a retaining arm which can be fixed on the supporting base.

In this context, for optional mounting on the guard-rail or the hand rail, the supporting base displays a clamping plate with a bulge which can, for example, be screwed onto the outside of the guard-rail or fixed in place in the desired position on the hand rail by means of a clamping device. In order to permit pivoting of the supporting base even when fixed to the outside of the guard-rail, the supporting base can be pivotable in fixable fashion via a joint in the first plane mentioned above.

The retaining arms for fixing the guiding elements or tensioning ropes are fixed on the supporting bases in such a position that the tensioning rope is taut and can hold the sun protection cloth.

In a one-piece configuration of the supporting base and the retaining arm, the mount consists, for example, of a metal bracket rotated through an angle of 90°, which is under elastic pretension for tensioning the rope when fixed appropriately.

In order to be able to pivot the retaining arm into different positions relative to the supporting base and fix it in the desired position, another advantageous configuration of the invention can be provided with an adapter forming an intermediate element between the retaining arm and the supporting base. This adapter can realise the described function of the supporting arm by way of corresponding fixing plates that permit variable positioning of the retaining arm.

If the supporting base is fixed on the hand rail of the balcony guard-rail, the supporting base preferably has, as previously mentioned, a bulge which reaches around the hand rail on one side and interacts with a clamping plate on the other side of the hand rail. The flanks of the bulge preferably enclose an angle of roughly 90° to 120°, so that hand rails with circular cross-sections of various diameters are suitable for fixing the supporting base.

Moreover, the bulge can also be curved in the shape of an arch, in order to avoid excessively high linear forces of pressure which could cause damage to the hand rail.

In order to be able to fix the supporting base to a hand rail with a rectangular cross-section, another configuration of the invention is provided with a clamping element with a curved outer side and a U-shaped recess on the inside. In this context, the lateral flanks of this recess are expediently step-shaped, so that they can be expanded and applied with the respectively fitting steps flush against the corresponding sides of the hand rail. The curved outside means that the supporting base can easily be fixed in different positions, it being advantageous to roughen or notch the outside of the clamping element and/or the insides of the flanks for fixing in the selected position.

In another configuration of the invention, the supporting arm is connected to one end of a retaining rod, the other end of which rests, for example, against the house wall extending above the balcony or a balcony roof, where it can be screwed or clamped in place. The upper guiding element for the sun protection cloth can then be fitted between the upper ends of the retaining rods, allowing the sun protection cloth to be put up without having to make fixing holes in the masonry.

In this way, the sun protection cloth can also be taken down again without leaving dowel holes or the like.

In another version of the fixing system, a tensioning frame is provided for guiding the upper and lower ends of the sun protection cloth, this frame consisting of two retaining struts for fixing on the house wall and guiding elements mounted at a distance from the retaining struts. This tensioning frame serves to support a second, upper sun protection cloth, which may possibly be stationary.

In this context, another guiding element is provided in the region of the front guiding element for the upper sun protection cloth, its purpose being to fix the lower sun protection cloth. This produces a shade system consisting of two sun protection cloths, this preferably being used when there is no balcony with a balcony roof or a house wall above the projecting balcony to be shaded.

The tensioning frame or the retaining struts can be supported by means of the previously mentioned retaining rods, the angular setting or position or which can be fixed at random due to the variable or pivotable mounting of the lower supporting arms.

An example of the invention is illustrated in the drawings and described in detail below on the basis of the drawings. The drawings show the following:

DESCRIPTION OF THE PREFERRED EMBODIMENTS

Figure 1:
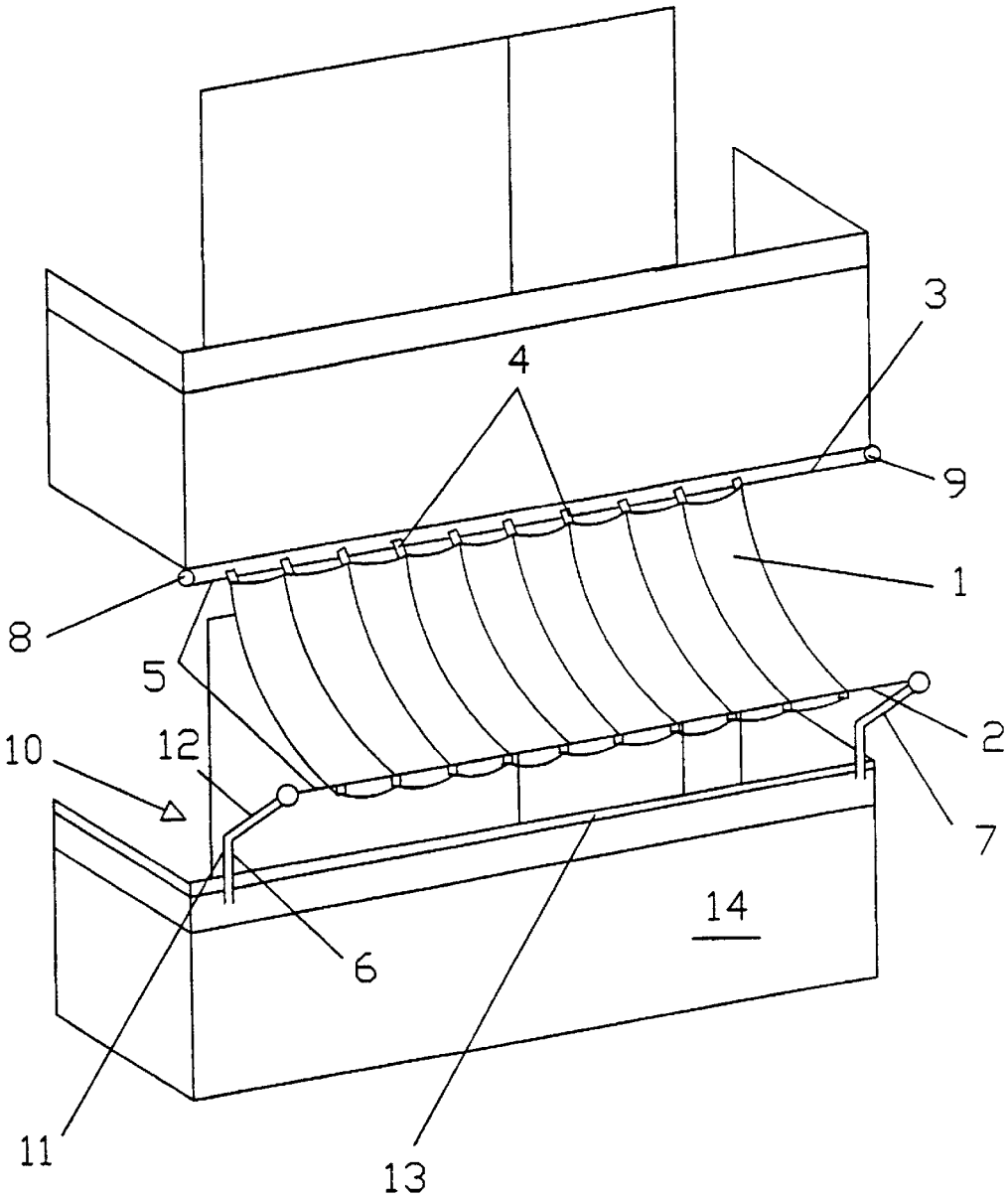
FIG. 1: A schematic representation of one version of the system for fixing a sun protection cloth for a projecting balcony.
Figure 2:
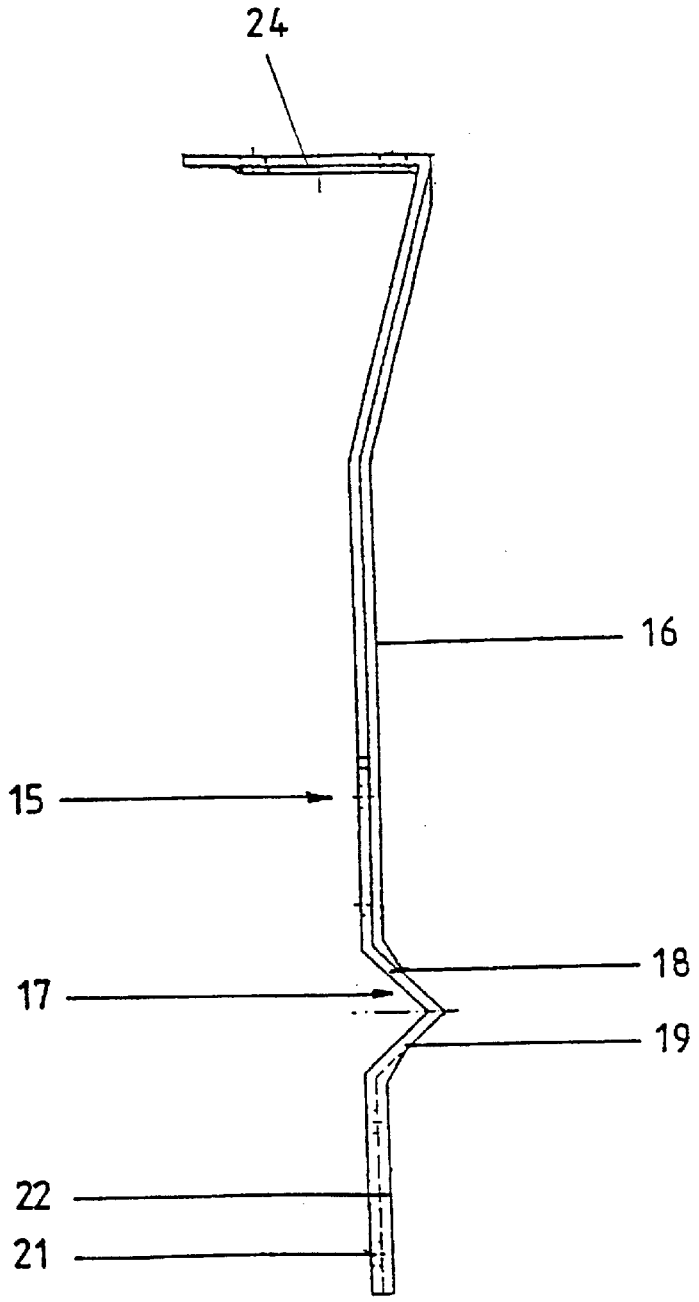
FIG. 2: A longitudinal section through a supporting base.

The perspective, schematic drawing in FIG. 1 shows two so-called projecting balconies one above the other, the lower one of which is shaded by means of sun protection cloth 1. Sun protection cloth 1 is detachably mounted on lower guiding element 2 and upper guiding element 3 with the aid of sliding hooks 4 in a manner permitting displacement in their longitudinal direction. Guiding elements 2, 3 each consist of a tensioning rope 5, which is supported in each case by two lower stretching or retaining devices 6, 7 or upper stretching and retaining devices 8, 9. Lower stretching and retaining devices 6, 7 are designed as supporting arm 10, which consists of supporting base 11 and retaining arm 12. Supporting base 11 is clamped in place on hand rail 13 of balcony guard-rail 14 in the position shown. Upper stretching and retaining devices 8, 9 are fixed on the underside of the balcony roof of the upper balcony.

FIGS. 2 to 5 and 8 illustrate the individual components of a supporting arm for lower tensioning rope 5 in a four-part configuration. Supporting base 15 consists of an angled bracket 16 with an integrally moulded bulge 17. Flanks 18, 19 of bulge 17 enclose an angle of 90°.

Figure 3:
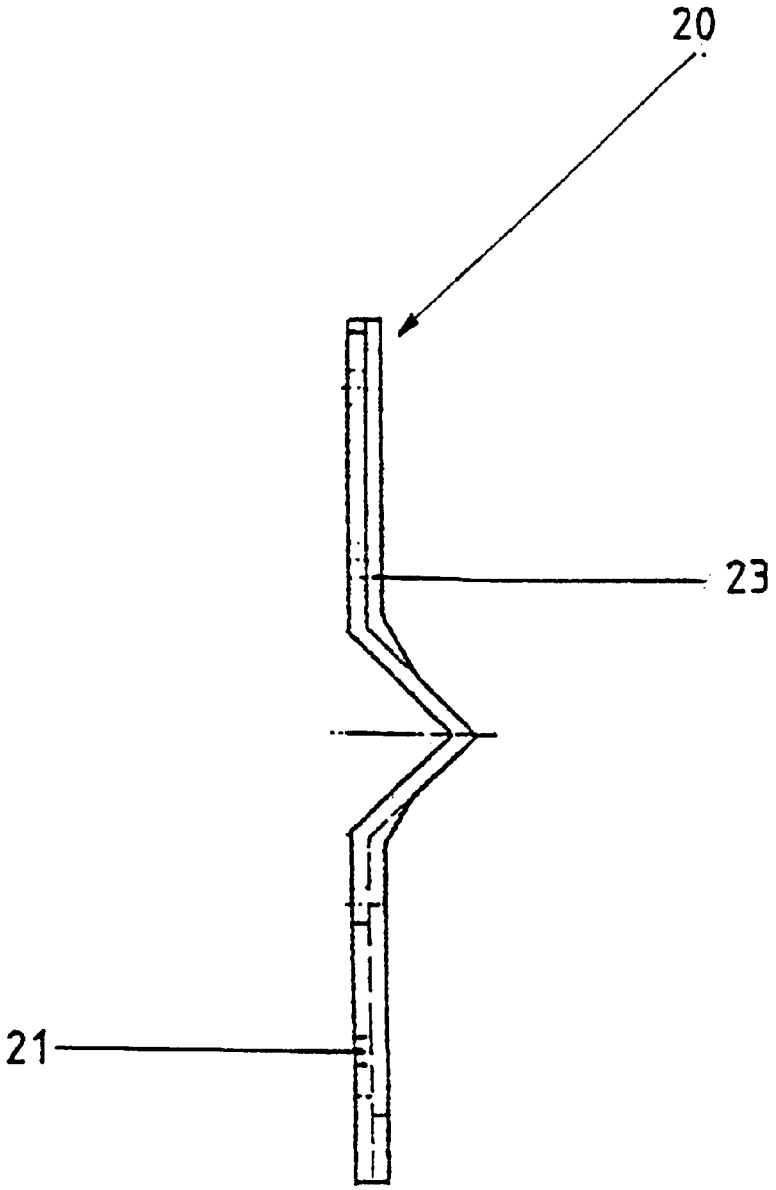
FIG. 3: A longitudinal section through a clamping plate which interacts with the supporting base pursuant to FIG. 2 when fixed on the hand rail of a guardrail.

Bracket 16 is placed against hand rail 13 of guard-rail 14 in the area of bulge 17 and interacts with clamping plate 20, a cross-section of which is shown in FIG. 3 and which is placed against the rear of hand rail 13 during assembly of supporting base 15. Supporting base 15 is clamped to hand rail 13 with the aid of screws (not shown) reaching through drilled holes 21. Clamping plate 20 and bracket 16 are provided with beads 22 and 23 for reasons of stability.

Figure 4A:
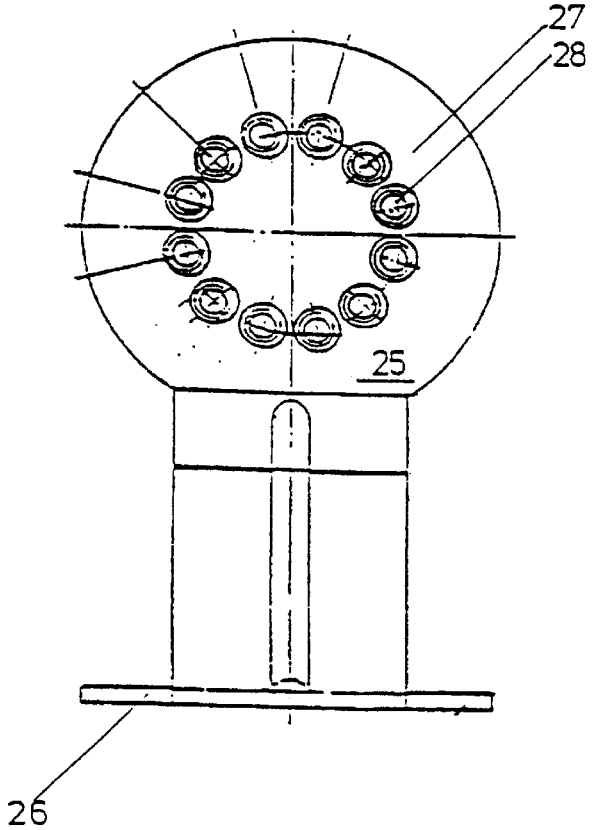
FIGS. 4*a* and 4*b*: A side view and a top view of an adapter for fixing on the supporting base pursuant to FIG. 2, FIG. 5: The top view of a retaining arm for fixing on the adapter pursuant to FIGS. 4*a* and 4*b*, FIG. 6: A cross-section through a clamping element curved in the shape of an arch.
Figure 4B:
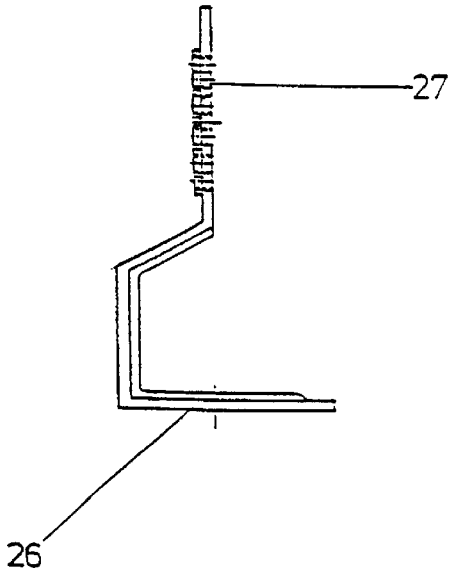

Angled adapter element 25, shown in FIGS. 4*a* and 4*b*, is placed on top of angled plate 24 of supporting base 15 or bracket 16 and fixed with the aid of fixing screws which pass through corresponding drilled holes in angled plate 25 or foot 26 of the adapter element. Adapter element 25, which again has a bead, carries a perforated plate 27 with a number of drilled holes 28, arranged an intervals of 30°.

Figure 5:
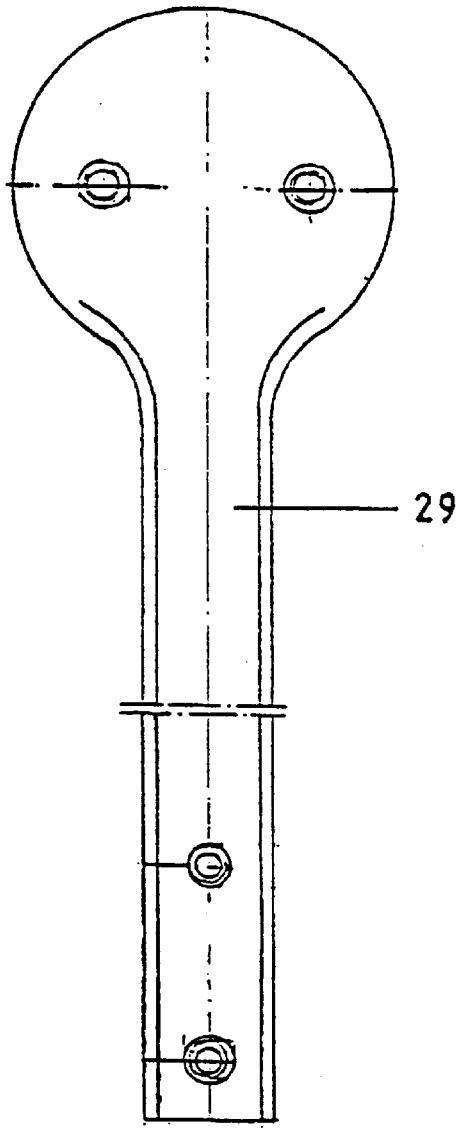

Retaining arm 29, shown in a top view in FIG. 5, is now fixed in the desired position on perforated plate 27 by means of screw connections. As a result of the design of perforated plate 27, the angular position of retaining arm 29 can be varied, so that a tensioning rope 5 fixed on retaining arm 29 can be tautened without additional tensioning elements, although it is, of course, also possible to provide additional tensioning anchors for fixing tensioning rope 5, by means of which the tension of rope 5 can be adjusted without altering the angular position of retaining arm 29.

Figure 8:
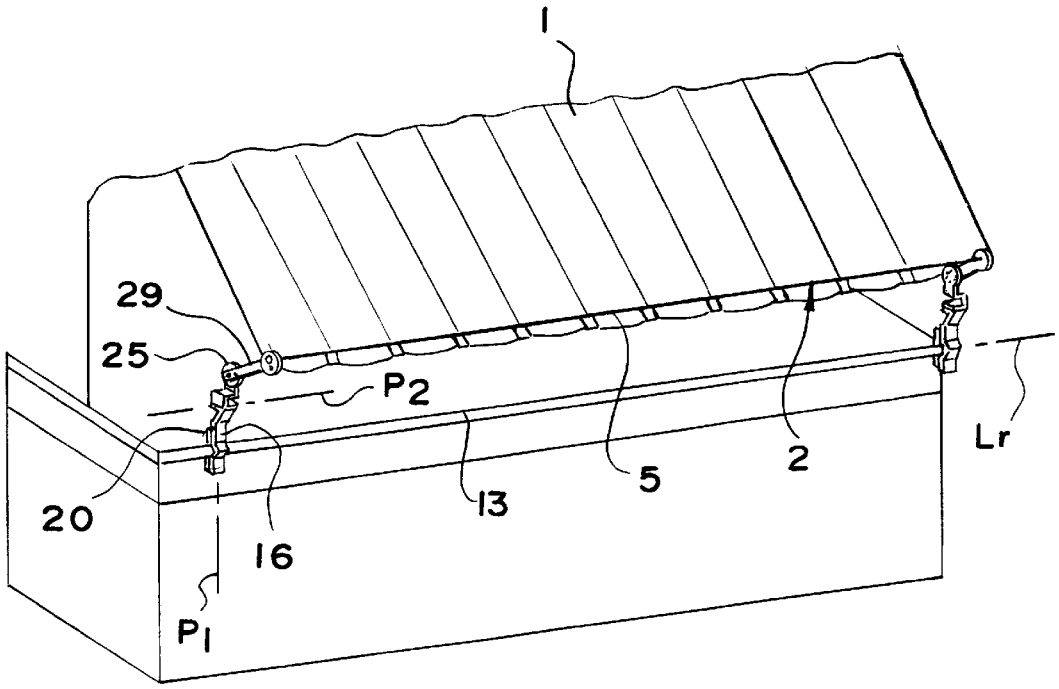
FIG. 8: A fragmentary front perspective view similar to FIG. 1, and illustrates the components of FIGS. 2 through 6 assembled and utilized in a pair located between a balcony hand rail and a lower guiding element of a sun protection cloth.

As is best illustrated in FIG. 8, the lower retaining devices 6, 7, 16, 25 are attached to the rail 13, 14 so as to be pivotable and fixable in a first plane P1 which is substantially perpendicular to a longitudinal axis Lr of the rail 13, 14. The lower retaining devices 6, 7, 16, 25 are also pivotable and fixable in a second plane P2 located substantially perpendicular to the first plane P1.

Figure 6:
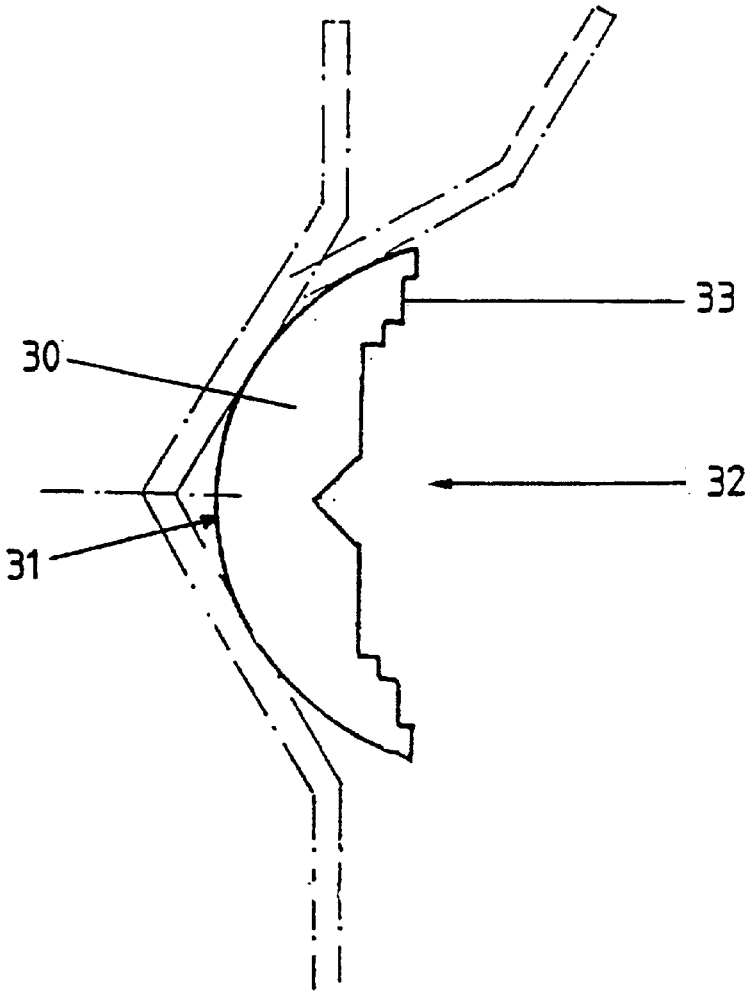

Clamping element 30, a cross-section of which is shown in FIG. 6, can be used in order also to be able to clamp supporting base 15 in place in any angular position on hand rails 13 with a rectangular cross-section. This clamping element 30 consists of a semi-circular, curved segment 31 with a U-shaped recess 32 on the inside. Lateral flanks 33 of curved segment 31 widen in step-shaped fashion, so that clamping element 30 can be placed against different rectangular cross-sections in a manner preventing rotation.

Figure 7:
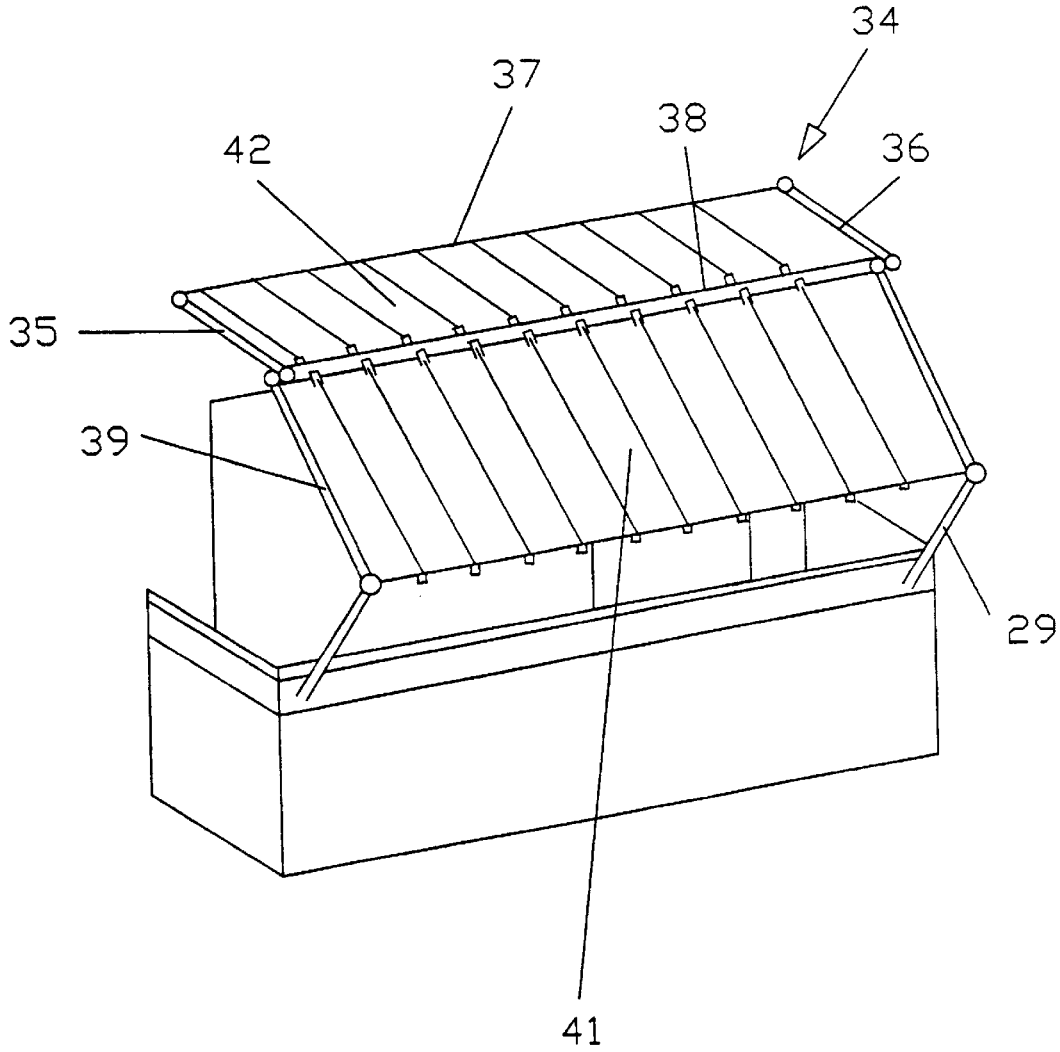
FIG. 7: A schematic representation of a version of the fixing system where two separate sun protection cloths are provided for shading.

In the version of the fixing system pursuant to FIG. 7, the supporting arms described can be used for the lower tensioning rope. However, as there is no upper balcony roof on this balcony, the upper tensioning rope is, in this case, fixed to tensioning frame 34, which consists of two lateral retaining struts 35, 36 and guiding elements 37, 38 mounted between them. Tensioning frame 34 is fixed to the house wall above the balcony and is supported by retaining rods 39, 40 which, in turn, are supported on retaining arms 29 for the lower guiding element.

Tensioning frame 34 serves not only to fix lower sun protection cloth 41, but also to set up an upper sun protection cloth 42, so that the balcony shown is completely shaded.

Although a preferred embodiment of the invention has been specifically illustrated and described herein, it is to be understood that minor variations may be made in the apparatus without departing from the spirit and scope of the invention, as defined the appended claims.

What is claimed is:

1. A system for fixing sun protection cloths to balconies or patios of houses comprising:

an upper guiding element (3) having a first end and a second end;

upper retaining devices (8,9) supporting the respective first and second ends of the upper guiding element (3);

a lower guiding element (2) having a first end and a second end, the lower guiding element (2) being arranged at a height below and substantially parallel to the upper guiding element (3);

a sun protection cloth (1) being attached at a top side to the upper guiding element (3) and being attached at a bottom side to the lower guiding element (2);

lower retaining devices (6, 7, 16, 25) supporting the respective first and second ends of the lower guiding element (2), the lower retaining devices (6, 7, 16, 25) being constructed and arranged for attachment to a rail (13 or 14) so as to be pivotable and fixable in a first plane (P1) located substantially perpendicular to a longitudinal axis (Lr) of the rail (13 or 14) and fixable in a second horizontal plane located substantially perpendicular to the first plane (P1) to thereby selectively tension the lower guiding element (2); and connection means (15, 20) for securing the lower retaining devices (6, 7, 16, 25) to the rail (13 or 14).

2. The fixing system as defined in claim 1 wherein the upper retaining devices (8, 9) are constructed and arranged to be fixed on one of a house and a balcony roof.

3. The fixing system as defined in claim 1 wherein the connection means is one of a detachable clamp-type connector and a detachable screw-type connector.

4. The fixing system as defined in claim 1 wherein the lower retaining devices (6, 7) each include a supporting arm (10) having a supporting base (15), a retaining arm (12 or 29), first pivot means (15, 20) for relatively pivoting and fixing said supporting base (15) to said rail (13 or 14) for pivotal movement in said first plane, and second pivot means (25, 29) for pivoting and fixing said retaining arm (12 or 29) relative to said supporting base (15) for pivotal movement in said second plane.

5. The fixing system as defined in claim 4 wherein the lower retaining devices (6, 7) further include an adapter (25) attached between the supporting base (15) and the retaining arm (12 or 29) to enable the retaining arm (12 or 29) to be pivoted and fixed in the second plane.

6. The fixing system as defined in claim 5 wherein the connection means (15, 20) includes the supporting base (15) and a clamping plate (20), the supporting base (15) has a bulge (17) that is constructed and arranged to be rotatably fixed on a portion of the rail (13 or 14), the bulge has flanks (18, 19) that extend outwardly from the supporting base (15) and are inclined toward each other to form the bulge (17), the clamping plate has a bulge that is constructed and arranged to be rotatably fixed on a portion of the rail (13 or 14) opposite to the portion of the rail (13, 14) that the bulge (17) of the supporting base (15) is affixed, the bulge of the clamping plate (20) is substantially a mirror image of the bulge (17) of the supporting base (15), and each of the bulges is arranged in mirror image opposition to each other when the clamping plate (20) is connected to the supporting base (15).

7. The fixing system as defined in claim 4 wherein each supporting arm (10) is connected to a first end of a retaining rod (39 or 40), a second end of each retaining rod (39 or 40) is constructed and arranged to be fixed on one of a house and a balcony roof above the lower guiding element (2), and the upper guiding element (3) is fitted between the second end of each retaining rod (39 or 40).

8. The fixing system as defined in claim 4 wherein the connection means (15, 20) includes the supporting base (15) and a clamping plate (20), the supporting base (15) has a bulge (17) that is constructed and arranged to be rotatably fixed on a portion of the rail (13 or 14), the bulge has flanks (18, 19) that extend outwardly from the supporting base (15) and are inclined toward each other to form the bulge (17), the clamping plate has a bulge that is constructed and arranged to be rotatably fixed on a portion of the rail (13 or 14) opposite to the portion of the rail (13, 14) that the bulge (17) of the supporting base (15) is affixed, the bulge of the clamping plate (20) is substantially a mirror image of the bulge (17) of the supporting base (15), and each of the bulges is arranged in mirror image opposition to each other when the clamping plate (20) is connected to the supporting base (15).

9. The fixing system as defined in claim 8 wherein the flanks (18, 19) of the bulge (17) of the supporting base (15) enclose an angle of substantially between 90° and 120°.

10. The fixing system as defined in claim 8 wherein the flanks of the bulge (17) of the supporting base (15) are curved in the shape of an arch.

11. The fixing system as defined in claim 8 including a clamping element (30) having a curved outer side facing the flanks (18, 19) and a substantially U-shaped recess (32) on an inside with legs (33) which widen in step-shaped fashion for engagement with the rail (13 or 14), and the rail (13 or 14) has a substantially rectangular cross-sectional shape.

12. The fixing system as defined in claim 11 wherein at least one of the outside of the clamping element (30) and the insides of the flanks (18, 19) are at least one of roughened, notched and arched.

13. The fixing system as defined in claim 1 including a tensioning frame (34) having lateral retaining struts (35, 36) and a first guiding element (37) at a back end of the tensioning frame (34) connected between first ends of the lateral retaining struts (35, 36) and a second guiding element (38) at a front end of the tensioning frame (34) connected between second ends of the lateral retaining struts (35, 36), a second sun protection cloth attached between the first and second guiding elements (37, 38) of the tensioning frame (34), and the front end of the tensioning frame (34) is affixed to the upper retaining devices (8, 9).

14. The fixing system as defined in claim 13 wherein the back end of the tensioning frame (34) is constructed and arranged to be affixed to a house wall.

15. The fixing system as defined in claim 13 wherein the retaining rods (39, 40) support the tensioning frame (34).

* * * * *